US005318205A

United States Patent [19]

Delaney, Jr.

[11] Patent Number: 5,318,205

[45] Date of Patent: Jun. 7, 1994

[54] SPRAY DISPENSING DEVICE HAVING A TAPERED MIXING CHAMBER

[75] Inventor: Henry W. Delaney, Jr., North Branford, Conn.

[73] Assignee: Emson Research, Inc., Bridgeport, Conn.

[21] Appl. No.: 924,725

[22] Filed: Aug. 3, 1992

Related U.S. Application Data

[63] Continuation-in-part of Ser. No. 745,538, Aug. 15, 1991, Pat. No. 5,183,186.

[51] Int. Cl.[5] ..... B65D 37/00

[52] U.S. Cl. ..... 222/211; 222/212; 222/484; 222/488; 222/632; 239/327; 239/401; 239/405; 239/470

[58] Field of Search ..... 222/206, 211, 212, 215, 222/484, 488, 554, 631, 632, 633; 239/327, 328, 401, 405, 470

[56] References Cited

U.S. PATENT DOCUMENTS

| | | | |
|---|---|---|---|
| 1,154,163 | 9/1915 | Ballou . | |
| 1,229,029 | 6/1917 | Burbage . | |
| 1,716,525 | 6/1929 | Leong . | |
| 1,729,979 | 10/1929 | Bell . | |
| 1,732,513 | 10/1929 | Holmes . | |
| 1,977,500 | 10/1934 | Tierman | 221/60 |
| 2,009,027 | 7/1935 | Sheehy | 221/60 |
| 2,605,022 | 7/1952 | Nieland | 222/159 |
| 3,141,579 | 7/1964 | Medlock | 222/207 |
| 3,163,362 | 12/1964 | McFee | 239/401 |
| 3,170,633 | 2/1965 | Castelli | 239/327 |
| 3,185,352 | 5/1965 | Ghisolfi | 222/193 |
| 3,474,936 | 10/1969 | McDonnell | 222/211 |
| 3,510,061 | 5/1970 | Peczeli et al. | 239/470 X |
| 3,967,765 | 7/1976 | Micallef | 222/554 |
| 4,015,753 | 4/1977 | Bennett | 222/193 |
| 4,020,982 | 5/1977 | Micallef | 222/554 |
| 4,024,992 | 5/1977 | Schmid | 222/211 |
| 4,122,979 | 10/1978 | Laauwe | 222/193 |
| 4,157,789 | 6/1979 | Laauwe | 239/327 |
| 4,162,749 | 7/1979 | Bennett | 222/633 |
| 4,186,882 | 2/1980 | Szczepanski | 239/327 |
| 4,401,270 | 8/1983 | McKinney | 239/327 |
| 4,473,185 | 9/1984 | Peterson et al. | 239/405 X |
| 5,183,186 | 2/1994 | Delaney, Jr. | 222/211 |

FOREIGN PATENT DOCUMENTS

| | | | |
|---|---|---|---|
| 1416199 | 8/1988 | U.S.S.R. | 239/405 |
| 1153264 | 5/1969 | United Kingdom . | |
| 2198521 | 6/1988 | United Kingdom | 239/405 |

*Primary Examiner*—Andres Kashnikow
*Assistant Examiner*—Joseph A. Kaufman
*Attorney, Agent, or Firm*—Kenyon & Kenyon

[57] ABSTRACT

A spray dispensing device is provided which can be used with non-pressurized containers. The device includes passageways for directing streams of air and liquid to a mixing chamber wherein the liquid is broken up into droplets and emitted as a fine spray through an orifice. An annular air passageway is concentrically disposed around a liquid passageway, both of which lead to the mixing chamber wherein the annular stream of air will be deflected by tapered walls of the mixing chamber to converge and impinge open the core stream of liquid, at a point in proximity to the orifice. The device may include a dip tube for the liquid which is provided with a check valve for retaining liquid at a high level in the dip tube after each spray cycle so that spraying is nearly instantaneous upon actuation.

11 Claims, 7 Drawing Sheets

| UPPER | IN | LOWER | UNDER | UPPER | IN | LOWER | UNDER | UPPER | IN | LOWER | UNDER |
|---|---|---|---|---|---|---|---|---|---|---|---|
| | | | | 173 | 3.0 | 150 | 88.6 | 29.5 | 2.4 | 25.4 | 7.5 |
| | | | | 150 | 5.6 | 129 | 83.0 | 25.4 | 1.7 | 21.9 | 5.8 |
| | | | | 129 | 7.9 | 111 | 75.1 | 21.9 | 1.2 | 18.9 | 4.6 |
| | | | | 111 | 8.9 | 96.0 | 66.2 | 18.9 | 1.0 | 16.3 | 3.6 |
| 564 | 0.0 | 487 | 100 | 96.0 | 10.1 | 82.5 | 56.1 | 16.3 | 0.8 | 14.1 | 2.8 |
| 487 | 0.0 | 420 | 100 | 82.5 | 9.6 | 71.5 | 46.5 | 14.1 | 0.6 | 12.1 | 2.2 |
| 420 | 0.1 | 362 | 99.9 | 71.5 | 9.2 | 61.5 | 37.3 | 12.1 | 0.4 | 10.4 | 1.7 |
| 362 | 0.6 | 313 | 99.3 | 61.5 | 7.6 | 53.0 | 29.7 | 10.4 | 0.3 | 9.05 | 1.4 |
| 313 | 1.2 | 270 | 98.1 | 53.0 | 6.3 | 45.8 | 23.4 | 9.05 | 0.3 | 7.80 | 1.2 |
| 270 | 1.8 | 233 | 96.3 | 45.8 | 5.5 | 39.5 | 17.9 | 7.80 | 0.3 | 6.70 | 0.9 |
| 233 | 2.3 | 201 | 94.1 | 39.5 | 4.5 | 34.1 | 13.4 | 6.70 | 0.3 | 5.80 | 0.5 |
| 201 | 2.5 | 173 | 91.6 | 34.1 | 3.4 | 29.5 | 9.9 | 5.80 | 0.5 | 1.50 | 0.0 |

| | | |
|---|---|---|
| SOURCE = :SAMPLE | BEAM LENGTH= 2.4 mm<br>LOG. DIFF. = 3.287 | MODEL indp |
| FOCAL LENGTH = 300mm<br>PRESENTATION = lds | OBSCURATION = 0.0925<br>VOLUME DISTRIBUTION | VOLUME CONC. = 0.674 %<br>Sp.S.A 0.1203 $m^2$/cc. |

| |
|---|
| SPAN 1.71 |
| D[4,3] 87.86 µm |
| D[3,2] 49.89 µm |
| D[v,0.9] 158.74 µm |
| D[v,0.1] 29.53 µm |
| D[v,0.5] 75.34 µm |

FIG. 5

| UPPER | IN | LOWER | UNDER | UPPER | IN | LOWER | UNDER | UPPER | IN | LOWER | UNDER |
|---|---|---|---|---|---|---|---|---|---|---|---|
| | | | | 173 | 3.5 | 150 | 86.2 | 29.5 | 2.5 | 25.4 | 7.4 |
| | | | | 150 | 6.4 | 129 | 79.8 | 25.4 | 1.7 | 21.9 | 5.6 |
| | | | | 129 | 8.6 | 111 | 71.2 | 21.9 | 1.2 | 18.9 | 4.4 |
| | | | | 111 | 9.2 | 96.0 | 62.0 | 18.9 | 1.0 | 16.3 | 3.5 |
| 564 | 0.0 | 487 | 100 | 96.0 | 9.9 | 82.5 | 52.1 | 16.3 | 0.8 | 14.1 | 2.7 |
| 487 | 0.0 | 420 | 100 | 82.5 | 8.9 | 71.5 | 43.2 | 14.1 | 0.6 | 12.1 | 2.1 |
| 420 | 0.3 | 362 | 99.7 | 71.5 | 8.2 | 61.5 | 35.1 | 12.1 | 0.4 | 10.4 | 1.7 |
| 362 | 0.8 | 313 | 98.9 | 61.5 | 6.7 | 53.0 | 28.4 | 10.4 | 0.3 | 9.05 | 1.4 |
| 313 | 1.4 | 270 | 97.5 | 53.0 | 5.5 | 45.8 | 22.9 | 9.05 | 0.3 | 7.80 | 1.1 |
| 270 | 2.1 | 233 | 95.3 | 45.8 | 5.0 | 39.5 | 17.9 | 7.80 | 0.3 | 6.70 | 0.8 |
| 233 | 2.7 | 201 | 92.6 | 39.5 | 4.4 | 34.1 | 13.5 | 6.70 | 0.3 | 5.80 | 0.5 |
| 201 | 3.0 | 173 | 89.7 | 34.1 | 3.5 | 29.5 | 9.9 | 5.80 | 0.5 | 1.50 | 0.0 |

| | | |
|---|---|---|
| SOURCE = :SAMPLE | BEAM LENGTH= 2.4mm<br>LOG. DIFF. = 3.694 | MODEL indp |
| FOCAL LENGTH = 300mm<br>PRESENTATION = lds | OBSCURATION = 0.0937<br>VOLUME DISTRIBUTION | VOLUME CONC. = 0.0703 %<br>Sp.S.A 0.1167 $m^2/cc$. |

| |
|---|
| SPAN 1.83 |
| D[4,3] 93.23 μm |
| D[3,2] 51.40 μm |
| D[v,0.9] 175.81 μm |
| D[v,0.1] 29.57 μm |
| D[v,0.5] 79.80 μm |

FIG. 7

SPRAY DISPENSING DEVICE HAVING A TAPERED MIXING CHAMBER

This is a continuation-in-part application of Ser. No. 745,538 filed on Aug. 15, 1991 now U.S. Pat. No. 5,183,186.

FIELD OF THE INVENTION

The invention relates generally to devices for atomizing fluent materials. More particularly, this invention relates to highly efficient dispensing arrangement for use with squeeze type containers.

BACKGROUND OF THE INVENTION

Although squeeze bottle types sprayers have been used for many years, such sprayers were largely replaced for a long period of time by pressurized can dispensing systems. A major advantage to the use of pressurized cans is the nearly instantaneous spraying which occurs upon actuation. However, there has been an increasing concern over the harmful effects on the atmosphere of the propelling gases, such as fluorocarbons, which are used in such pressurized cans. In addition, pressurized can dispensing systems are relatively expensive to manufacture. Accordingly, squeeze bottle type sprayers and manual pump sprayers have become more prevalent in recent years.

Products which can be dispensed in the form of a spray can be easily atomizable liquids, such as water based materials, or viscous materials which are more difficult to atomize such as oil based materials. In the case of a pressurized can there is sufficient force available for mechanical means to break up liquid droplets into a fine spray. However, in squeeze bottle type sprayers the force required to break up droplets must be supplied manually, that is by squeezing the bottle. Therefore, it is much more difficult to achieve a high degree of atomization with such bottles.

Squeeze bottle type sprayers typically utilize a dip tube for directing liquid to a mixing chamber. Upon squeezing the bottle, air located above the liquid level is forced under pressure through a passage toward the mixing chamber where it impinges on a stream of the liquid in an effort to break up the liquid into droplets. The liquid is dispersed in a spray pattern through an orifice in the mixing chamber.

One major drawback to the use of conventional venturi squeeze bottles is that they do not always effectively atomize the liquid into a fine spray characterized by a symmetrical circular spray pattern and a symmetrical droplet size distribution. Furthermore, they do not always effectively atomize relatively viscous liquids.

SUMMARY OF THE INVENTION

It is an object of the invention to provide a spray dispensing device for use with a non-pressurized container, such as a squeeze bottle, which very effectively atomizes fluent material stored in the container.

It is a further object of the invention to provide a spray dispensing device which produces a spray which exhibits a circular and symmetrical spray pattern wherein the droplet size distribution is symmetrical and conforms to a bell curve.

In accordance with the invention a spray dispenser is provided having a dip tube which can extend into a container, such as a squeeze bottle, holding a quantity of liquid. The top of the dip tube is connected to a ball-check valve assembly having a ball which ordinarily rests on top of a conduit of restricted diameter. An air passage in the spray dispenser can connect the inside of the bottle with a mixing chamber in the dispenser. A separate product passage leads from the top of the ball-check to a mixing chamber and is directed toward a spray orifice in the mixing chamber. The air passage is an annular passageway which is concentrically disposed around a portion of the product passage leading to the mixing chamber.

When the bottle is squeezed, the resulting pressure build up forces air into the mixing chamber and liquid up the dip tube. The liquid forces the ballcheck to open and the liquid is directed toward the mixing chamber. Simultaneously, air is forced through the annular air passage. The annular 360° stream of air converges and impinges upon the core stream of liquid when deflected by tapered walls of the mixing chamber, at a point in proximity to the spray orifice. This causes a particularly effective atomization of the liquid and a fine spray is expelled through the orifice. The spray pattern is symmetrical and circular and the droplets exhibit a symmetrical droplet size distribution which ordinarily conforms to a bell curve.

As the pressure in the bottle is relieved, the ball drops down back onto the conduit of restricted diameter thereby trapping product in the dip tube. Thus, product will be retained in the dip tube at a high level, above the liquid level in the bottle, ready for the next squeeze cycle. In this way the lag time which ordinarily occurs prior to spraying is eliminated.

The product passage is formed in a valve which is housed in a body of the spray dispenser. In a closed position of the valve, the product passage is completely closed to the inside of the squeeze bottle, however, the air passage may be open. As the valve is adjusted toward a fully open position, the liquid passage opens. Continued adjustment increases the extent of communication between the product passage and the ballcheck thereby increasing the volume of liquid per unit of time allowed to flow into the mixing chamber (i.e., the flow rate) and, hence, the ratio of liquid to air in the spray.

BRIEF DESCRIPTION OF THE DRAWINGS

These and other features and advantages of the present invention will become apparent from consideration of the following specification when taken in conjunction with the accompanying drawings in which:

FIG. 5 is a table of data of spray droplet sizes for a spray of a first test liquid emitted by the spray dispensing device of the invention

FIG. 7 is a table of data of spray droplet sizes for a spray of a second test liquid emitted by the spray dispensing device of the invention

DESCRIPTION OF THE PREFERRED EMBODIMENTS

Figure 1:
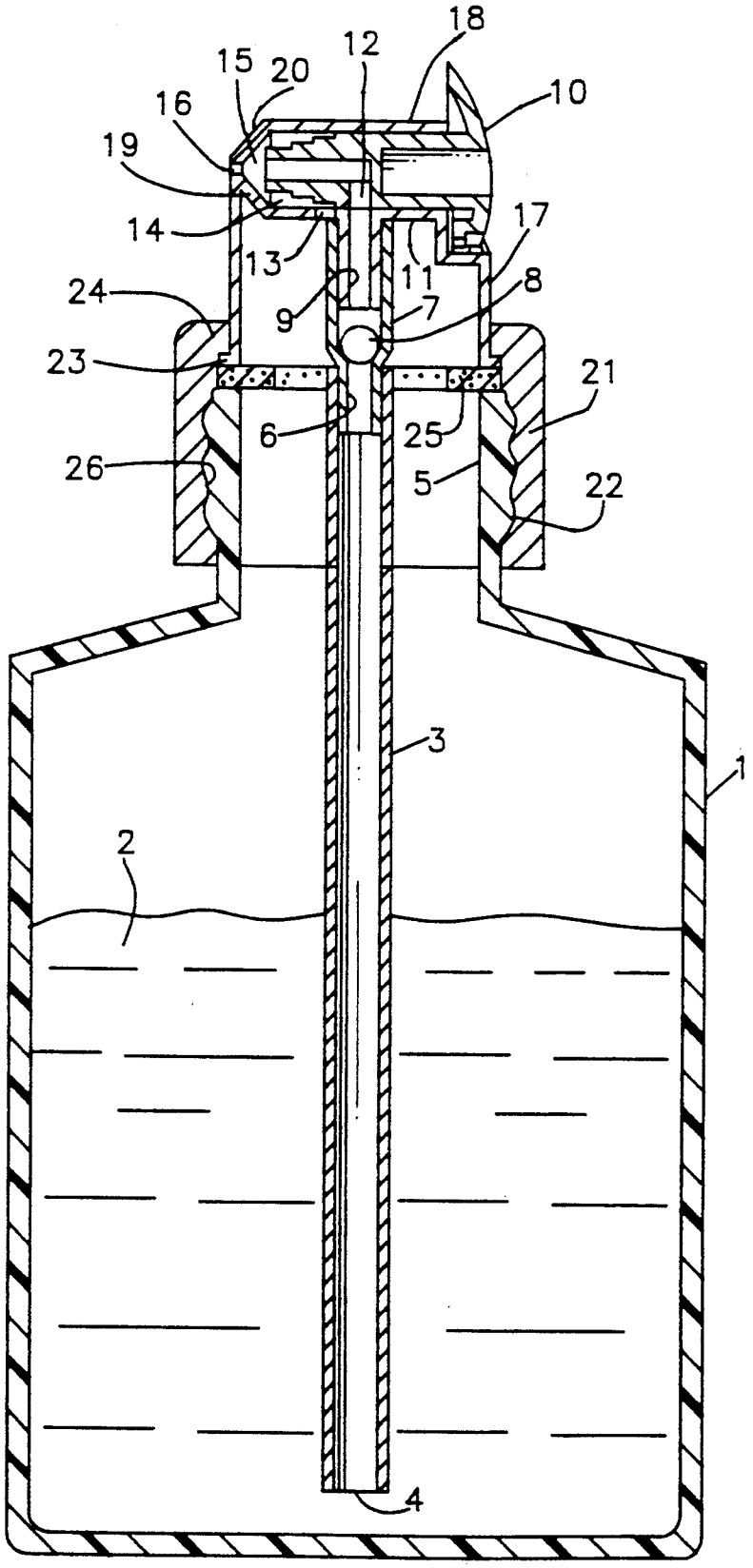
FIG. 1 is a cross-sectional view of a spray dispensing device in accordance with the invention, mounted on a squeeze type bottle, illustrating the valve in its fully open position.

Referring now more particularly to the drawings, and to those embodiments of the invention here chosen by way of illustration, it will be seen in FIG. 1 that the spray dispensing system of the present invention will be described in connection with a squeezable bottle 1 holding a quantity of a liquid or other fluent material 2. Squeezable bottle 1 can be made from any suitable plastic known in the art.

A spray dispensing device housing 17 is adapted to be mountable atop a neck 5 of bottle 1. The device includes a dip tube 3 which is sized so that its bottom open end 4 is disposed near the bottom of bottle 1 when the spray dispensing device is mounted on the bottle. The top end of dip tube 3 receives a restricted conduit 6 of a ballcheck valve 7. Restricted conduit 6 communicates with dip tube so as to allow fluid 2 to pass therethrough. The inner diameter of restricted conduit 6 is smaller than the diameter of ball 8 of ballcheck valve 7 so that ball 8 ordinarily sits atop restricted conduit 6. When ball 8 is in this position, the ballcheck valve 7 is closed so that the top end of dip tube 3 is also closed. The inner diameter of the remainder of ballcheck valve 7 is larger than the diameter of ball 8. In this way ball 8 is free to move upward in response to upward movement of fluid in the dip tube to open ballcheck valve 7.

The top of ballcheck valve 7 receives a coaxially disposed feed tube 9 which allows for the passage of fluid from restricted conduit 6 toward valve 10. Feed tube 9 has an inner diameter which is smaller than the diameter of ball 8 so as to limit the movement of ball 8 in an upward direction. Therefore, feed tube 9 is positioned a small distance upward from ball 8 so that ball 8 is free to move upward to open ballcheck valve 7.

For simplicity of construction feed tube 9 is an extension of a valve wall 11 of housing 17. Feed tube 9 of valve wall 11 can communicate with a product passageway 12 within valve 10 when valve 10 is in an open position, which will be described. Valve wall 11 is provided with an air orifice 13 which communicates with an annular air passageway 14. As illustrated in FIGS. 1 and 2, the annular air passageway 14 is defined as the space between the body of valve 10 and the valve walls 11 and 18, so that it is concentrically disposed around the portion of the product passageway 12 which leads to the mixing chamber in a horizontal direction. Valve 10 is rotatably received in the cavity between valve walls 11 and 18 of spray dispenser housing 17.

Tapered portions 19 and 20 of valve walls 11 and 18, respectively, define a cavity therebetween which shall be referred to as mixing chamber 15. The tapered portions 19 and 20 may define a cone. A portion of the product passageway 12 leads to mixing chamber 15 in a generally horizontal direction. As illustrated in FIGS. 1 and 2, the annular air passageway 14 is concentrically disposed around the portion of the product passageway 12 which leads to the mixing chamber 15 in a horizontal direction. Tapered portions 19 and 20 terminate before meeting to define spray orifice 16 of mixing chamber 15.

Housing 17 is connected to the top of bottle neck 5 by a ring 21. Ring 21 may be a screw cap whose inner surface is provided with helical threads 26 defining grooves which are engageable with helical threads 22 on the outer surface of neck 5. An outwardly extending lip 23 around the bottom periphery of housing 17 engages with an inwardly extending lip 24 of ring 21 to lock housing 17 onto bottle neck 5. A foam gasket 25 may be provided between lip 23 and the top of bottle neck 5 for enhanced sealing.

The spray dispensing device can be conveniently removed from bottle 1 as a unit by simply unscrewing ring 21 to separate housing 17 from bottle neck 5. This feature has the advantage of allowing the bottle 1 to be refilled with product 2. The spray dispensing system is then easily reconnected to bottle neck 5 by ring 21.

Valve 10 is housed within the cavity between valve walls 11 and 18 of housing 17. Valve 10 is rotatable about its longitudinal axis between a completely closed position (FIG. 2) and a completely open position (FIG. 1). In the completely closed position (FIG. 2) the product passageway 12 is not aligned with the feed tube 9. As illustrated in FIG. 2, in this position the body of valve 10 completely seals off feed tube 9. Yet, in the closed position, the air passageway 14 can remain in communication with the air orifice 13 as illustrated in FIG. 2.

The structure of valve 10 is such that as the valve is rotated toward the completely open position, the air passageway 14 is already aligned with air orifice 13 before product passageway 12 begins to communicate with feed tube 9. Upon continued rotation of the valve toward the completely open position, the product passageway begins to communicate with feed tube 9, allowing a certain extent of communication between the feed tube and mixing chamber so that a thin stream of liquid can pass to the mixing chamber 15 at a certain flow rate. The flow rate is the volume of liquid which can flow per unit of time through the feed tube, through the product passageway and into the mixing chamber. Upon continued rotation of the valve toward the completely open position, the extent of the communication between feed tube 9 and product passageway 12 increases, thereby increasing the extent of communication between the feed tube and the mixing chamber to allow a thicker stream of liquid to pass to the mixing chamber (i.e., an increased flow rate). However, the extent of communication between air orifice 13 and mixing chamber 15 is already at its constant maximum before product passageway 12 even begins to communicate with feed tube 9. Therefore, the ratio of liquid to air which is delivered to the mixing chamber will increase as the valve 10 is rotated toward the completely open position thereby increasing the wetness of the spray. In the completely open position of valve 10, the extent of communication between product passageway 12 and feed tube 9 is at a maximum so that the ratio of liquid to air delivered to the mixing chamber is at a maximum. Thus, it can be seen that the wetness of the spray can be controlled by adjusting valve 10.

It should be appreciated by those skilled in the art that variations in the design of valve 10 are possible. For example, instead of being rotatable, the valve may be slidable so that the extent of communication between the product passageway 12 and feed tube 9 varies upon sliding motion of the valve.

Figure 2:
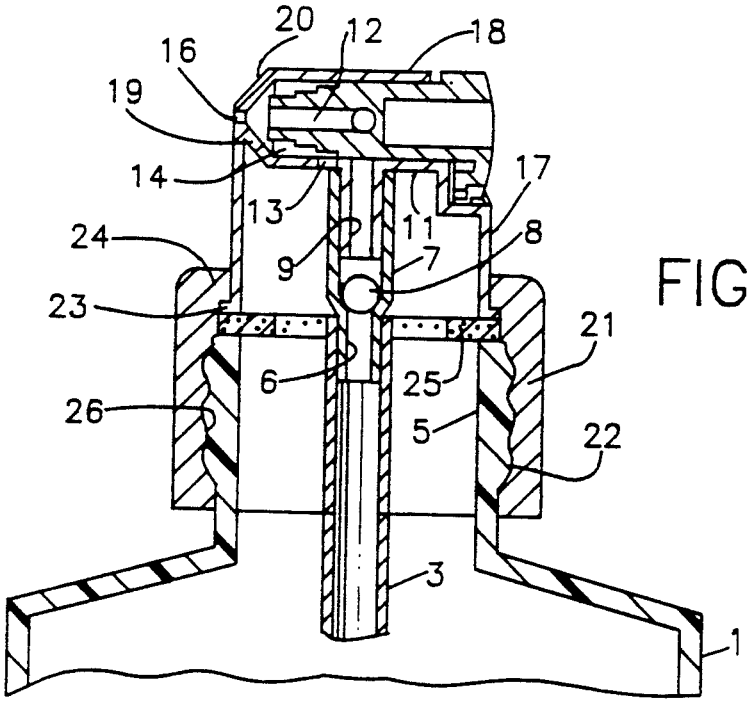
FIG. 2 is the same cross-sectional view which is illustrated in FIG. 1, but with the valve in its fully closed position.
Figure 3:
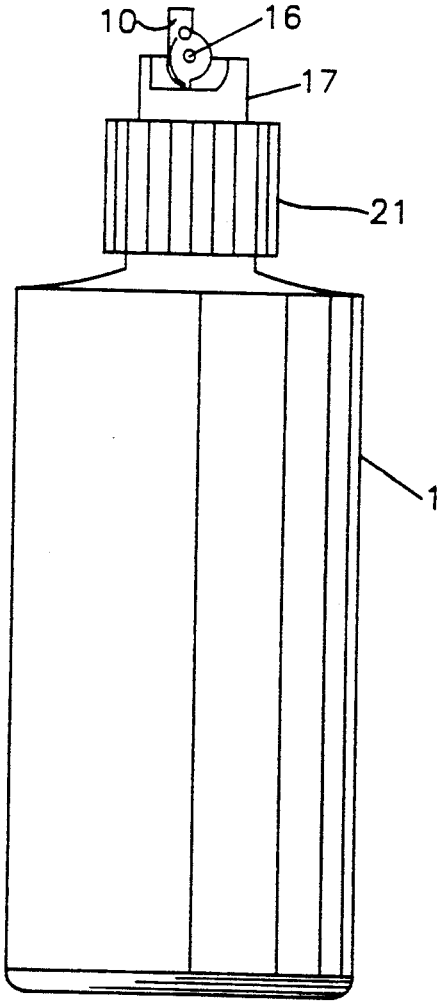
FIG. 3 is a perspective view of a squeeze bottle which includes a spray dispensing device in accordance with the invention.
Figure 4:
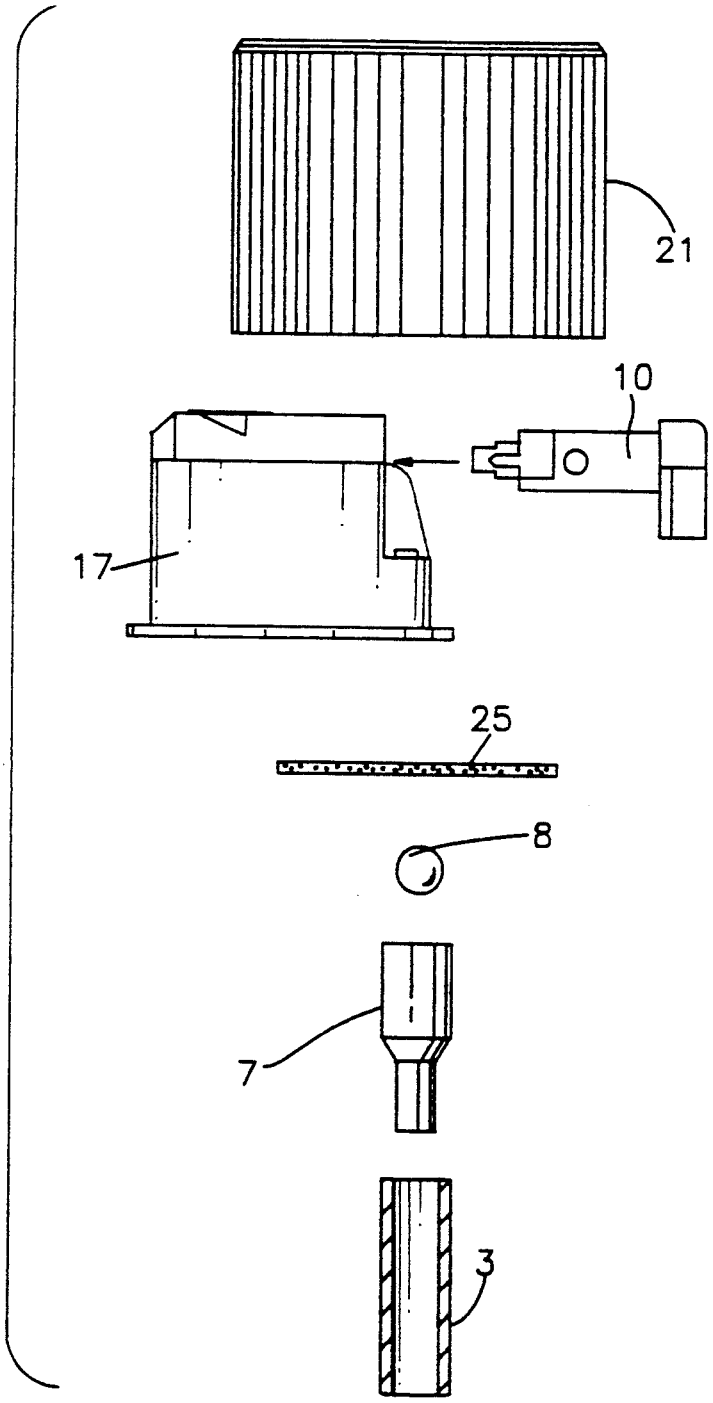
FIG. 4 is a segmented view of a spray dispensing device is accordance with the invention which illustrates the individual components of the device.
Figure 6:
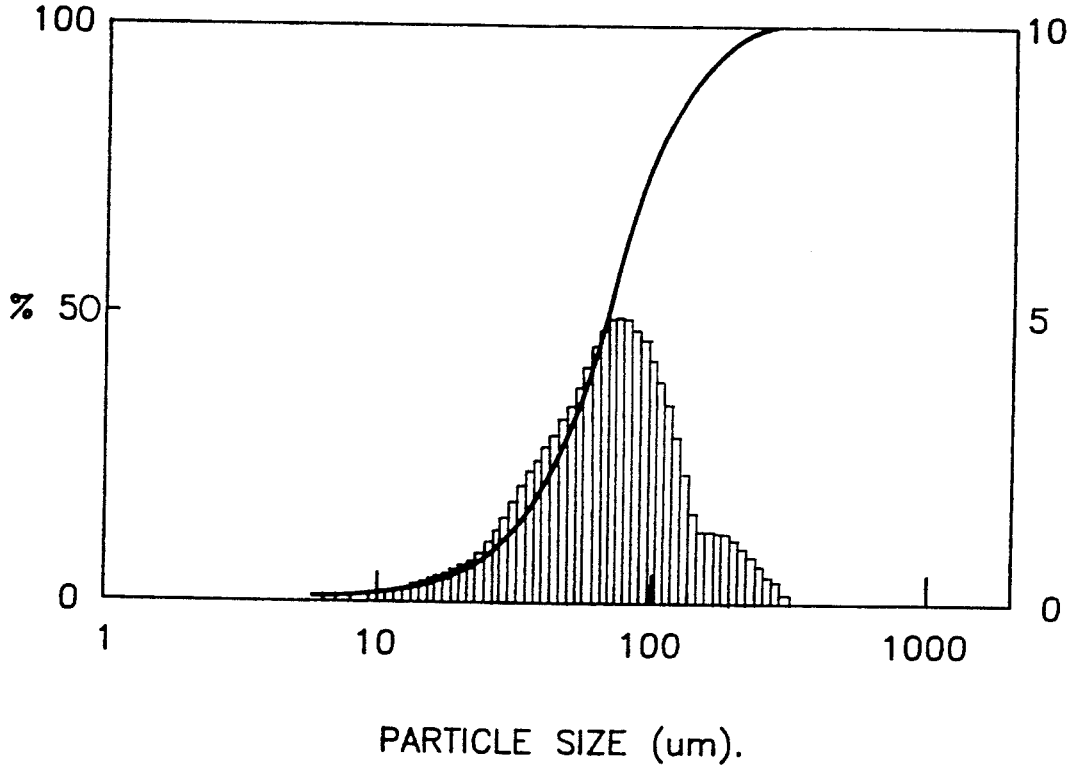
FIG. 6 is a graph which illustrates the particle size distribution of spray droplets emitted by the spray dispensing device of the invention for a first test liquid.

In the preferred embodiment the valve 10 is rotatable 90° from the completely closed position (FIG. 2) to the completely open position (FIGS. 1 and 3).

The operation of the spray dispensing device of the invention as used with a squeeze bottle will now be explained by describing the path of fluid and air. Upon squeezing the bottle 1 the pressure inside the bottle increases urging fluid 2 up dip tube 3. Fluid is forced through restricted conduit 6 and pushes ball 8 upward off of the top of conduit 6 thereby opening ballcheck valve 7. The fluid is then free to flow into feed tube 9 toward product passageway 12. From passageway 12 the fluid stream is injected into mixing chamber 15 in a horizontal direction toward the spray orifice 16. It can be seen from FIGS. 1 and 2 that the product passageway 12 communicates with the mixing chamber 15 at a location which is directly opposite the spray orifice.

Upon squeezing the bottle the increase in pressure also forces air above the fluid level in the bottle through air orifice 13 into the annular air passageway 14. It can be seen that the distance which must be travelled by the air to reach the mixing chamber 15 is less than the distance which must be travelled by the liquid so that liquid does not reach the mixing chamber before the air. In this way, it is made certain that the fluid is mixed with air before emanating from orifice 16.

The annular air passageway 14 leads to the mixing chamber in a horizontal direction and communicates with the mixing chamber 15 at a location which is directly opposite the tapered or conical section 19, 20 of the mixing chamber. Tapered portions 19, 20 direct the annular air stream from passageway 14 at an acute angle to the central horizontal stream of liquid from passageway 12. Thus, the annular stream of air converges and impinges upon the core stream of liquid at a point in proximity to the spray orifice 16. The liquid is subjected to considerable turbulence which breaks it up and intimately mixes it with the air. The result is that a fine spray is propelled out of orifice 16 which exhibits a circular and symmetrical spray pattern wherein the droplets exhibit a symmetrical particle size distribution.

When pressure is released on the container it returns to its original shape as external air is drawn into the container through orifice 16. The drawing of air through orifice 16 cleans the orifice and the mixing chamber 15 after each squeeze cycle thereby inhibiting clogging of the orifice. This self-cleaning feature of the invention is particularly advantageous in the case of a viscous product where clogging is most frequently encountered.

The release of pressure also causes liquid to drop down feed tube 9 which helps ball 8 to drop thereby closing the top of restricted conduit 6. It will be appreciated that the closing of conduit 6 by ball 8 will trap liquid in feed tube 3. Thus, during the next squeeze cycle product will already be at a very high level in the dip tube so that less time will transpire before spray is emitted. In this way the present invention achieves nearly instantaneous spraying without the need for a pressurized container.

EXAMPLE

Figure 8:
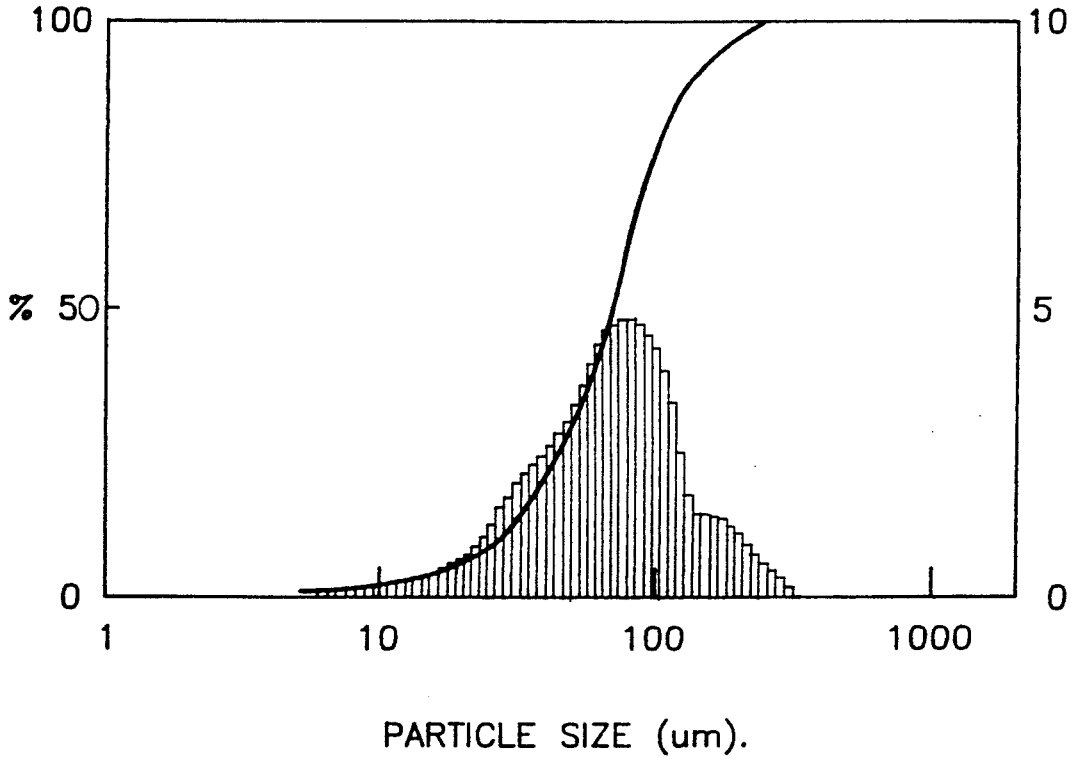
FIG. 8 is a graph which illustrates the particle size distribution of spray droplets emitted by the spray dispensing device of the invention for a second test liquid.

The spray dispensing device of the invention was used to atomize certain common household products. In an attempt to learn the distribution of droplet sizes of the resulting spray droplets, the sprays were tested using a Malvern Model No. 2600 Particle Sizing Unit. Two common household products atomized were the disinfectant Listerine TM and the air freshener Glade TM. In FIGS. 5, 6, 7 and 8, the number of droplets in the spray having a certain droplet size were plotted against the droplet sizes. It can be seen that for each test product (FIGS. 5 and 6=Listerine; FIGS. 7 and 8=Glade) the droplet size distribution exhibits a nice bell curve with the majority of droplets having about an average droplet size. It was also observed that when the spray was directed on a planar sheet of material that the spray pattern was circular and symmetrical. Without intending to be bound by any theory, it is believed that these results are attributable to the concentric arrangement of the annular air passageway around the liquid passageway and the taper of the mixing chamber, whereby the annular stream of air converges and impinges upon the core stream of liquid in a direction toward and in proximity to the spray orifice.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are accordingly to be regarded in an illustrative rather than a restrictive sense.

What is claimed is:

1. A squeeze bottle sprayer which is actuated upon squeezing the bottle to force liquid up a dip tube and emit a liquid-air spray through a spray orifice, comprising:

a squeezable bottle containing a volume of liquid and air above the liquid;

a dip tube extending into said volume of liquid;

a sprayer body having a tapered section defining a mixing chamber therein, the tapered section being tapered in a direction toward a spray orifice which is defined through the sprayer body at a terminal point of the tapered section;

a valve defining a liquid passageway therethrough connecting the dip tube with the mixing chamber in an open position of the valve, at least a portion of the liquid passageway being disposed in a direction toward the spray orifice and having a longitudinal axis aligned through said portion and said spray orifice, the liquid passageway communicating with the mixing chamber at a location directly opposite to the spray orifice, the valve and the liquid passageway being selectively movable by rotation about said longitudinal axis to a closed position wherein the mixing chamber is disconnected from the dip tube;

an air passageway, concentrically disposed around said portion of the liquid passageway, the air passageway connecting an interior of the bottle containing said volume of air with the mixing chamber and the air passageway communicating with the mixing chamber at a location directly opposite to the tapered section of the sprayer body;

whereby upon actuation of the squeeze bottle sprayer a stream of air from the air passageway will be deflected by the tapered section of the sprayer body to converge and impinge upon a core stream of liquid from the liquid passageway in the mixing chamber to atomize the stream of liquid.

2. The squeeze bottle sprayer according to claim 1 wherein the valve is received within a housing and wherein the air passageway is defined between an outer surface of the valve and an inner surface of the housing.

3. The squeeze bottle sprayer according to claim 2 wherein the housing has an underside wall which defines an air orifice therethrough, said air orifice allowing for communication between the air passageway and the interior of the bottle.

4. A spray dispensing device, for use with a non-pressurized container holding a volume of a liquid and air above the liquid wherein said container is actuated by squeezing it to force liquid through a dip tube of the spray dispensing device, the spray dispensing device comprising:

a dispenser housing defining a cavity therein, with an air orifice and a liquid orifice being defined through said housing and a spray orifice being defined at a terminal point of a tapered section of said housing, said tapered section defining a mixing chamber therein;

a dip tube extending from an underside of the housing and communicating with said liquid orifice; and a valve received in said cavity and terminating at said mixing chamber, the valve defining a liquid passageway therein, the liquid passageway communicating with the mixing chamber and with the liquid orifice in an open position of the valve, the valve and the liquid passageway being selectively movable by rotation about a longitudinal axis thereof to a closed position wherein the mixing chamber is disconnected from the liquid orifice, and the valve and the dispenser housing defining an air passageway therebetween which is concentrically disposed around the liquid passageway, the air passageway communicating with the mixing chamber and with the air orifice, wherein a second of the liquid passageway is disposed toward the mixing chamber and the spray orifice in a horizontal direction along said longitudinal axis and communicates with the mixing chamber at a location which is directly opposite to the spray orifice, and wherein the air passageway is disposed toward the mixing chamber in said horizontal direction and communicates with the mixing chamber at a location which is directly opposite to the tapered section of the dispenser housing;

whereby, upon actuation of the container, a stream of air from the air passageway will be deflected by the tapered section to converge and impinge upon a core stream of liquid from the liquid passageway in the mixing chamber to atomize the stream of liquid.

5. The spray dispensing device according to claim 4 wherein the air passageway communicates with the mixing chamber and the air orifice in said closed position.

6. The spray dispensing device according to claim 4 further comprising means for retaining liquid in the dip tube at a level which is higher than a level of liquid in the container upon deactuation of the container.

7. The spray dispensing device according to claim 6 wherein the means for retaining liquid is a ballcheck means belonging to the dip tube.

8. The spray dispensing device according to claim 7 wherein the ballcheck means comprises a conduit and a ball, the conduit having a restricted section, characterized by a first inner diameter, communicating through a top of the dip tube, and a non-restricted section, characterized by a second inner diameter, communicating with said liquid orifice, said ball being disposed in said non-restricted section and being characterized by a third diameter which is greater than the first diameter and less than the second diameter such that the ball can move within the non-restricted section but not into the restricted section in response to movement of liquid through the conduit.

9. The spray dispensing device according to claim 8 further comprising a feed tube projecting from the underside wall of the spray dispenser housing and communicating with the liquid orifice and the non-restricted conduit, the feed tube being characterized by a diameter which is less than the third diameter so that the ball cannot move into the feed tube.

10. The spray dispensing device according to claim 4 further comprising means for retaining liquid in the dip tube at a level which is higher than a level of liquid in the container upon deactuation of the container.

11. A spray dispensing device, for use with a non-pressurized container holding a volume of a liquid and air above the liquid wherein said container is actuated by squeezing it to force liquid through a dip tube of the spray dispensing device, the spray dispensing device comprising:

a dispenser housing defining a cavity therein, with an air orifice and a liquid orifice being defined through said housing and a spray orifice being defined at a terminal point of a tapered section of said housing, said tapered section defining a mixing chamber therein;

a dip tube extending from an underside of the housing and communicating with said liquid orifice; and a valve received in said cavity and terminating at said mixing chamber, the valve defining a liquid passageway therein, the liquid passageway communicating with the mixing chamber and with the liquid orifice in an open position of the valve, the valve being selectively movable to a closed position wherein the mixing chamber is out of communication with the liquid orifice, and the valve and the dispenser housing defining an air passageway therebetween which is concentrically disposed around the liquid passageway, the air passageway communicating with the mixing chamber and with the air orifice in both the open position and the closed position of the valve, wherein a section of the liquid passageway is disposed toward the mixing chamber and the spray orifice in a horizontal direction and communicates with the mixing chamber at a location which is directly opposite to the spray orifice, and wherein the air passageway is disposed toward the mixing chamber in said horizontal direction and communicates with the mixing chamber at a location which is directly opposite to the tapered section of the dispenser housing;

whereby, upon actuation of the container, a stream of air from the air passageway will be deflected by the tapered section to converge and impinge upon a core stream of liquid from the liquid passageway in the mixing chamber to atomize the stream of liquid.

* * * * *